US006386863B1

(12) United States Patent
Sarv et al.

(10) Patent No.: US 6,386,863 B1
(45) Date of Patent: May 14, 2002

(54) COMPOUND BURNER VANE

(75) Inventors: Hamid Sarv, Canton; Jeffrey A. LaRose, Stow; Albert D. LaRue, Uniontown; Peter W. Waanders, Wadsworth, all of OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 09/551,066

(22) Filed: Apr. 18, 2000

Related U.S. Application Data

(62) Division of application No. 09/178,855, filed on Oct. 26, 1998, now Pat. No. 6,146,130, which is a division of application No. 08/584,785, filed on Jan. 11, 1996, now Pat. No. 5,827,054.

(51) Int. Cl.[7] ..... F23C 7/00; F23M 9/00

(52) U.S. Cl. ..... 431/184; 431/9; 431/183; 239/405; 239/406; 239/402.5

(58) Field of Search ..... 431/181, 184, 431/187, 189, 183; 60/748; 110/264, 265; 239/402.5, 423, 424, 476, 487, 463, 461, 403, 404, 405, 406, 399

(56) References Cited

U.S. PATENT DOCUMENTS

| | | | | |
|---|---|---|---|---|
| 1,602,180 A | | 10/1926 | Stillman | |
| 2,044,296 A | | 6/1936 | Hardgrove | 110/22 |
| 2,046,767 A | | 7/1936 | Campbell | 110/22 |
| 2,097,078 A | | 10/1937 | Peabody | 158/1.5 |
| 2,112,888 A | | 4/1938 | Greenawalt | 158/77 |
| 2,271,587 A | * | 2/1942 | Haynes | |
| 2,325,318 A | | 7/1943 | Hendrix | 110/104 |
| 2,515,813 A | | 7/1950 | Wiant | 158/1.5 |
| 2,647,568 A | | 8/1953 | Sloan | 158/76 |
| 3,014,523 A | * | 12/1961 | Huge | |
| 3,049,085 A | | 8/1962 | Musat et al. | 110/28 |
| 3,195,872 A | | 7/1965 | Schneider et al. | 431/183 |
| 4,175,640 A | * | 11/1979 | Birch et al. | |
| 4,217,756 A | * | 8/1980 | Laskody | |
| 4,457,241 A | | 7/1984 | Itse et al. | 110/347 |
| 4,464,108 A | * | 8/1984 | Korenyl | |
| 4,602,571 A | | 7/1986 | Chadshay | 110/264 |
| 4,902,221 A | | 2/1990 | Collins, Jr. et al. | 431/183 |
| 5,415,114 A | * | 5/1995 | Monro et al. | |
| 5,827,054 A | * | 10/1998 | Sarv et al. | |
| 6,146,130 A | * | 11/2000 | Sarv et al. | |

FOREIGN PATENT DOCUMENTS

| | | | |
|---|---|---|---|
| EP | 2815 | 7/1979 | 431/183 |
| GB | 658619 | 10/1951 | 239/402.5 |
| NL | 28694 | 12/1932 | 239/406 |

OTHER PUBLICATIONS

"Steam/Its Generation and Use," 40th Edition, The Babcock & Wilcox Company, pp. 13–3 to 13–11, 1992.

* cited by examiner

*Primary Examiner*—Carl D. Price
(74) *Attorney, Agent, or Firm*—Robert C. Baraona; Eric Marich

(57) ABSTRACT

A compound spin vane (CSV) for use in an air passage of a fossil fuel-fired burner. In one embodiment, the CSV is a multi-piece construction of platelike outer and inner vane elements connected to an intermediate platelike rail element. In another embodiment, the CSV includes at least two and possibly three vane portions, rigidly interconnected in spaced lateral relationship with respect to each other. If desired, the vane portions may be simple, curved planar surfaces, and may be arranged with trailing edges arranged at angles with respect to each other. The invention may be employed as a replacement for flat spin vanes found in secondary air passages of known single and dual register burners. When used in such manner in a single register burner, the invention changes secondary air flow characteristics so as to mimic those commonly found in a dual register burner.

17 Claims, 12 Drawing Sheets

$h_o$
52
52C
$\alpha_2$
52A
52D
$\alpha_1$
52B
LINE OF ATTACHMENT FOR OUTER VANE ON TOP
LINE OF ATTACHMENT FOR INNER VANE ON BOTTOM
$\delta$
51
$h_i$
53C
$\beta_2$
90°
53A
53D
$\beta_1$
53B
53
DIRECTION OF AIR FLOW

COMPOUND BURNER VANE

The present invention relates in general to furnace burners, and in particular to a new and useful spin vane for fossil fuel-fired burners. It is a divisional application of U.S. Ser. No. 09/178,855 Oct. 26, 1998 (now U.S. Patent No. 6,146,130), which is itself a divisional application of U.S. Ser. No. 08/584,785 filed Jan. 11, 1996 (now U.S. Patent No. 5,827,054).

BACKGROUND OF THE INVENTION

1. Field of the Invention

The present invention relates in general to furnace burners, and in particular to a new and useful spin vane for fossil fuel-fired burners.

2. Description of the Related Art

Among the key physical features of burners used in industrial and utility boilers are the spin vanes which typically are located in at least one annular secondary air flow passage that surrounds the burner fuel nozzle. These spin vanes function to change the flow direction of incoming secondary (combustion) air and to impart a swirl velocity on the air as it exits the burner and mixes with the burning fuel. The imparted swirl velocity changes the air-fuel mixing characteristics of the burner and by so doing affects the emission production level and unburnt carbon losses of the combustion process. The spin vanes usually are fabricated from flat sheet metal, and they may be situated in the annular air flow passage(s) so that they are either stationary or movable in relation to the incoming air. Where the spin vanes are movable, they often may be adjusted from a completely closed position to a fully opened position. Movable spin vanes can be useful in instances where field tuning a burner is needed to meet certain performance requirements specified by a burner user.

Spin vanes may be used in both single and dual register burners. FIG. 1 illustrates a known single register burner 10 of The Babcock & Wilcox Company (B&W) with spin vanes 11 located in annular secondary air flow passage 12 which surrounds burner nozzle 13. Pulverized coal and primary air, which serves principally as a coal transport medium, are supplied to burner 10 at inlet 14. Secondary air is delivered to annular secondary air flow passage 12 from windbox 15 which is positioned concentrically about passage 12. Secondary air flow from windbox 15 to passage 12 can be controlled by sliding air damper 16. Burner nozzle 13 and passage 12 respectively deliver the pulverized coal/primary air mixture and the secondary air to the interior of furnace 17 through opening 18 in furnace wall 19. As indicated in FIG. 1, spin vanes 11 induce a swirled air flow pattern which is directed into a burner flame.

FIG. 2 depicts a known dual register burner 20, also of B&W. Like the single register burner 10, the dual register burner 20 has a burner nozzle 13, a pulverized coal/primary air inlet 14 and a sliding damper 16. Dual register burner 20 is distinguishable from single register burner 10 by inner secondary air zone 22 and outer secondary air zone 24, both of which air zones encircle burner nozzle 13 and thereby serve as passages through which secondary air is delivered to the interior of furnace 17. Secondary air zones 22 and 24 are separated from one another by air separation plate 25 which is positioned concentrically about burner nozzle 13. Inner secondary air zone 22 and outer secondary air zone 24 have movable spin vanes 26. Outer secondary air zone 24 also has stationary spin vanes 28 located upstream of movable vanes 26 situated in the outer air zone. As indicated in FIG. 2, inner and outer secondary air mixing patterns respectively exit from inner secondary air zone 22 and outer secondary air zone 24 and are directed into a burner flame.

For further clarity, FIG. 3 shows an enlarged profile view of the known spin vanes 11 and 26 which have been pointed out respectively in FIG. 1 and FIG. 2, above. As shown in FIG. 3, the plate-like spin vane is defined by base edge 31, leading edge 32 which intersects one end of base edge 31 at obtuse angle A, trailing edge 33 which intersects the other end of base edge 31, also at obtuse angle A, and curved outer edge 34 which intercepts the ends of leading and trailing edges 32 and 33, which are farthest from base edge 31.

U.S. Pat. No. 1,620,180 discloses angled vanes with a projecting flange. The flange, however, is not placed in a flow path and is fixed to the vane for support purposes, and not for air flow direction.

U.S. Pat. No. 2,647,568 discloses vanes or ribs which are inclined relative to the burner's axis. While the vanes or ribs have flared and contoured surfaces, they do not have any extension perpendicular to part of the length.

U.S. Pat. No. 2,515,813 is a further example of angled vanes without an extension.

U.S. Pat. No. 3,049,055 discusses optimum vane angularity.

SUMMARY OF THE INVENTION

The present invention relates to various embodiments of a novel spin vane of the type used in fossil fuel-fired burners. More particularly, in a first embodiment three separate and distinct flat sheet metal elements are assembled and oriented relative to one another so as to provide a multi-piece spin vane which may be called a compound burner vane (CBV) or compound spin vane (CSV). The sheet metal elements are an outer vane element, an inner vane element and a rail element. Both outer and inner vane elements are aligned perpendicularly with respect to outer and inner faces of the rail element and are positioned so that the outer vane is attached to the outer face of the rail and the inner vane is attached to the inner face of the rail. While the outer and inner vane elements may be aligned relative to one another so that they divert the secondary air flow in the same direction both outside and inside of the rail element, the vane elements may be angled in relation to one another, preferably at an angle ranging from ten (10) to forty (40) degrees, so that they will divert the air flow in differing directions. Additionally, the profiles of either or both of the vane elements may be altered to create converging or diverging air flow patterns. A ratio of outer vane element height to inner vane element height ($h_o/h_i$) also may be established to provide an air flow pattern that is optimized for specific burner requirements. The structure of the invention has been found to change the secondary air flow characteristics of the known single register burner so 5. as to mimic those of the known dual register burner. Previous measurements suggest that certain combustion-generated pollutants are lower for the dual register burners than for their single register counterparts. Thus, the invention, when applied to a known single register burner that has already been put into service, allows the burner to be quickly and inexpensively modified so that the level of its emissions are reduced to a point which is comparable to that of the known dual register burner and so that the flame produced by the modified single register burner is shorter than that of the known dual register burner. The invention also may be used in the known dual register burner in the event that a need should arise to achieve emission standards more stringent than those currently encountered by users of the known dual register burner.

Accordingly, one aspect of the present invention is drawn to a multi-piece spin vane which may be used in an air passage of either a single register or a dual register fossil fuel-fired burner, and this vane is comprised of:

A plate-like, rectangular-shaped rail element oriented in the air passage such that an outer face of the rail element is directed toward an outer wall of the air passage and an inner face of the rail element is directed toward an inner wall of the air passage;

A plate-like outer vane element which has a base edge, leading and trailing edges and an outer edge, and which is fastened at the base edge to the outer face of the rail element so that the outer vane element and the outer face of rail element are perpendicularly aligned; and A plate-like inner vane element which also has a base edge, leading and trailing edges and an outer edge, and which is fastened to the inner face of the rail element so that the inner vane element and the inner face of the rail element are perpendicularly aligned.

Another aspect of the present invention is drawn to a fossil-fueled burner apparatus having means for providing a fossil fuel to an outlet end of the burner apparatus for combustion, a single annular air flow passage partially defined between an inner wall and an outer wall of the burner apparatus, and an arrangement of multi-piece spin vanes of the aforementioned construction installed and positioned within the annular air flow passage for imparting a spin to combustion air flowing through the annular air flow passage.

Yet another aspect of the present invention is drawn to a another form of a compound spin vane for imparting a spin to combustion air flowing through an annular air flow passage of a fossil-fueled burner apparatus, the passage being partially defined between an inner wall and an outer wall. This form of the compound spin vane comprises a first vane portion having a leading edge exposed to the oncoming flow of air, and a trailing edge located downstream thereof with respect to the flow of air as it passes by the first vane portion. The first vane portion also has an inner edge, and an outer edge located proximate to the outer wall of the annular air passage. The first vane portion also has opposite, lateral sides. A second vane portion having a leading edge exposed to the oncoming flow of air, a trailing edge downstream thereof with respect to the flow of air as it passes by the second vane portion, is also provided. The second vane portion also has an inner edge located proximate to the inner wall of the annular air passage, an outer edge, and opposite, lateral sides. Finally, means are provided for rigidly connecting a first lateral side of the second vane portion to one side of the first vane portion in spaced lateral relationship with respect to the first vane portion so that both the first and second vane portions move together as a unit when the compound spin vane is installed and positioned in the annular air flow passage of the burner apparatus.

Yet still another aspect of the present invention is drawn to a fossil-fueled burner apparatus having means for providing a fossil fuel to an outlet end of the burner apparatus for combustion, a single annular air flow passage partially defined between an inner wall and an outer wall of the burner apparatus, and an arrangement of compound spin vanes installed and positioned within the annular air flow passage for imparting a spin to combustion air flowing through the annular air flow passage, wherein some of the compound spin vanes comprise the foregoing construction.

Another aspect of the invention is to provide a compound burner vane (CBV) which is simple in design and is more economical to manufacture than single-piece vanes having complex shapes. As suggested from the foregoing summary, the invention also provides a user of existing single register burners with a low cost alternative to replacing such burners with higher cost dual register burners in order to reduce boiler emissions. By replacing existing single register burner vanes with the invention, a burner user also may significantly reduce the amount of boiler down time that otherwise would be required for total burner replacement.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4(*b*) provides a side elevational view of an outer vane element and an inner vane element, as well as a top plan view of a rail element of the spin vane shown in FIG. 4(*a*);

FIG. 5(*b*) provides a side elevational view of an outer vane element and an inner vane element, as well as a top plan view of a rail element of the spin vane shown in FIG. 5(*a*);

DESCRIPTION OF THE PREFERRED EMBODIMENTS

Figure 4A:
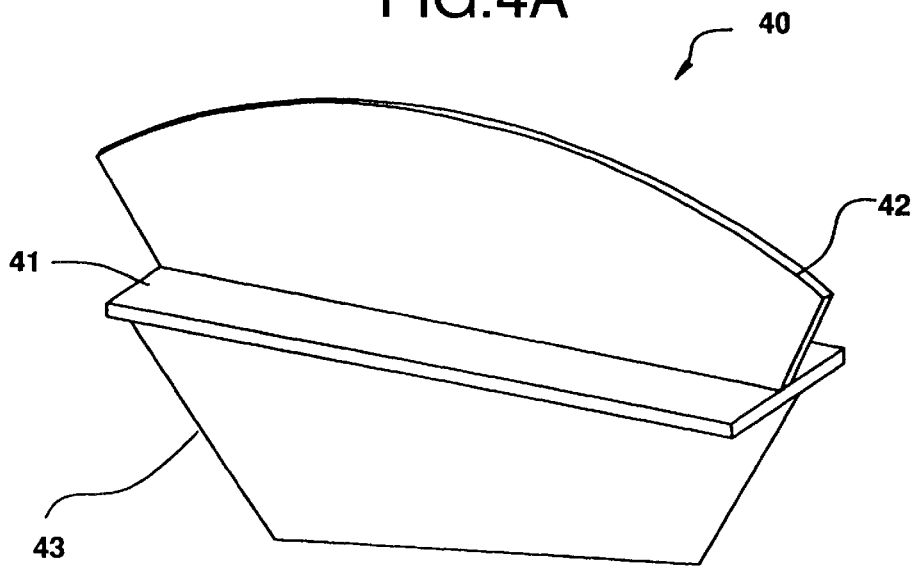
FIG. 4(*a*) is a perspective view of one embodiment of a spin vane constructed according to the invention.
Figure 4B:
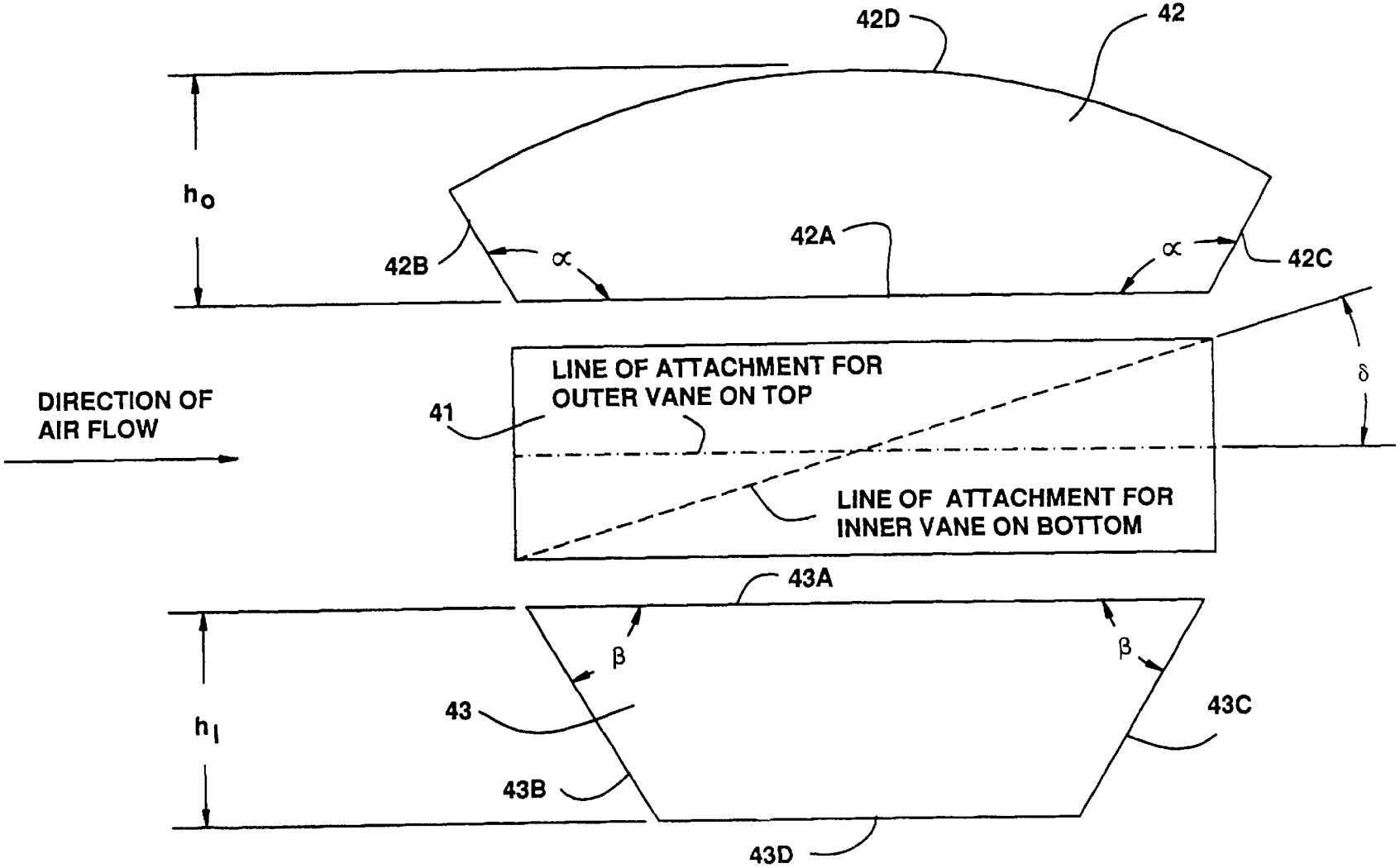

In the following discussion, like numerals represent the same or functionally similar elements throughout the several drawings. A first embodiment of the present invention, as shown in FIG. 4(*a*), involves a multi-piece spin vane 40 having three flat sheet metal elements: a rail element 41, an outer vane element 42 and an inner vane element 43. As shown in FIG. 4(*b*), rail element 41, when viewed from the top, has a rectangular shape. Rail element 41 will be oriented in a secondary air passage of a burner such that the outer vane element 42 will be directed toward an outer wall of the air passage and the inner vane element 43 will be directed toward an inner wall of the air passage.

Outer vane element 42, as also shown in FIG. 4(*b*), is defined by base edge 42A, leading edge 42B, trailing edge 42C and curved outer edge 42D. Base edge 42A is equal in length to rail element 41 and is intersected at one of its ends by leading edge 42B and at the other of its ends by trailing edge 42C. Equal obtuse angles, designated by $\alpha$ in FIG. 4(*b*), are formed by leading edge 42B and trailing edge 42C where they intersect base edge 42A. Curved outer edge 42D intercepts the ends of leading and trailing edges 42B and 42C, which are located farthest from base edge 42A. Preferably, the amount of curvature exhibited by curved outer edge 42D will correspond to the inside wall curvature of the air passage in which spin vane 40 is situated.

As also indicated in FIG. 4(*b*), inner vane element 43 has a profile which resembles an inverted isosceles trapezoid defined by base edge 43A, leading edge 43B, trailing edge 43C and outer edge 43D. The length of base edge 43A approximates that of the diagonal of rail element 41. Leading edge 43B and trailing edge 43C are of equal lengths and intersect opposite ends of base edge 43A to form equal acute angles designated $\beta$ in FIG. 4(*b*). Outer edge 43D is parallel to base edge 43A and intercepts the ends of leading edge 43B and trailing edge 43C, which are located farthest from base edge 43A.

Rail element 41, outer vane element 42 and inner vane element 43, when assembled, appear as depicted generally in FIG. 4(*a*). Outer vane element 42 is attached at base edge 42A to the outer face of rail element 41 so that base edge 42A runs parallel to and is positioned midway between the longer sides of rail element 41. Inner vane element 43 is secured at base edge 43A to the inner face of rail element 41 so that base edge 43A runs diagonally across rail element 41. The preferred method of affixing vane elements 42 and 43 to rail element 41 is to weld the elements to one another; however, any other suitable fastening method may be employed. Vane elements 42 and 43 are joined to rail element 41 so that they both are aligned perpendicularly with respect to the faces of rail element 41.

Figure 5A:
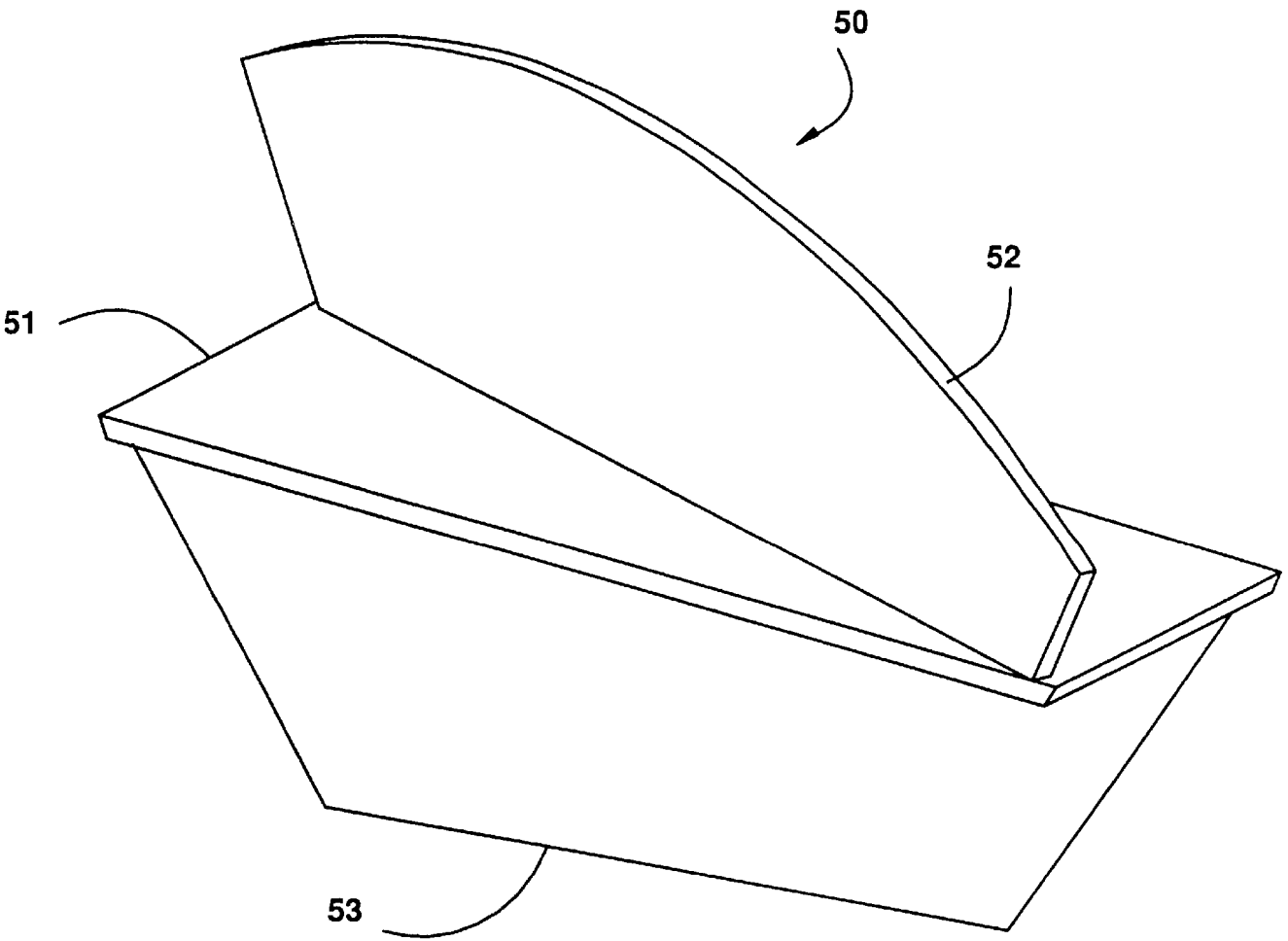
FIG. 5(*a*) is a perspective of another embodiment of a spin vane constructed according to the invention.
Figure 5B:
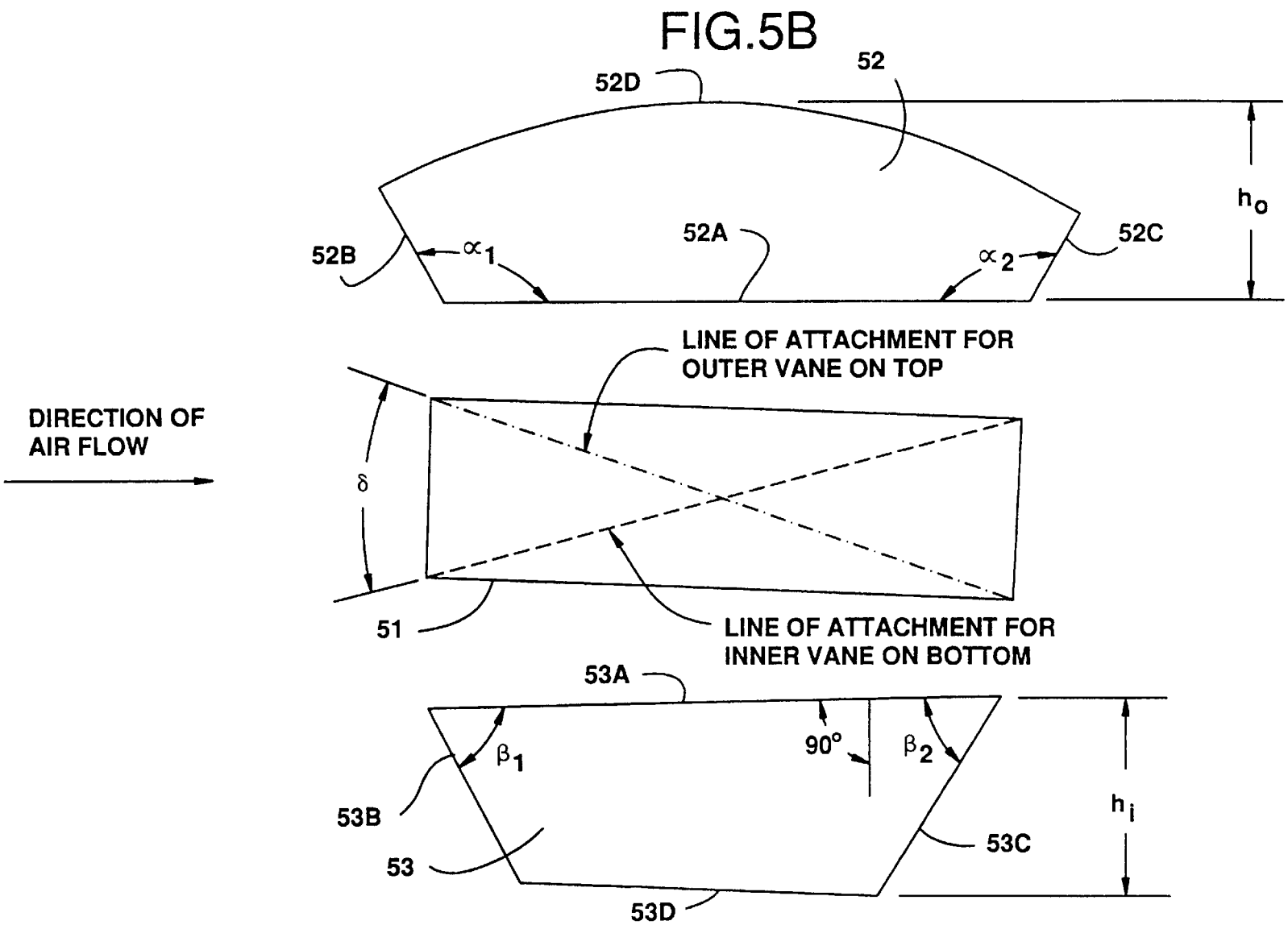
Figure 9:
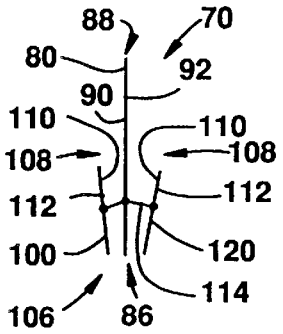
FIGS. 8–9 are schematic representations of side and end views, respectively, of the compound spin vane of FIGS. 6 and 7.
Figure 8:
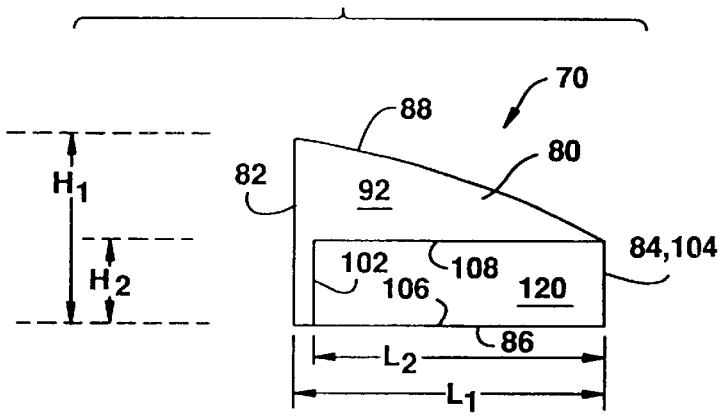

Another embodiment of the present invention is illustrated by FIGS. 5(*a*) and 5(*b*). Multi-piece spin vane 50 is comprised of rail element 51, outer vane element 52 and inner vane element 53. As in the case of spin vane 40, all elements of spin vane 50 are fabricated from flat sheet metal. Rail element 51, when viewed from the top, has a rectangular shape.

Outer vane element 52, is defined by base edge 52A, leading edge 52B, trailing edge 52C and curved outer edge 52D. Base edge 52A is equal in length to the diagonal of rail element 51 and is intersected at one of its ends by leading edge 52B and at the other of its ends by trailing edge 52C. Unequal obtuse angles, designated by $\alpha_1$ and $\alpha_2$, in FIG. 5(*b*), are formed respectively by leading edge 52B and trailing edge 52C where they intersect base edge 52A. Curved outer edge 52D intercepts the ends of leading and trailing edges 52B and 52C, which are located farthest from base edge 52A.

Inner vane element 53 has a trapezium-like profile which is defined by base edge 53A, leading edge 53B, trailing edge 53C and outer edge 53D. The length of base edge 53A is equal to the diagonal of rail element 51. Leading edge 53B and trailing edge 53C are of unequal lengths and intersect opposite ends of base edge 53A to form unequal acute angles respectively designated $\beta_1$ and $\beta_2$ in FIG. 5(*b*). Outer edge 53D intercepts the ends of leading edge 53B and trailing edge 53C, which are located farthest from base edge 53A.

FIG. 5(*a*) illustrates how rail element 51, outer vane element 52 and inner vane element 53 appear when assembled to form spin vane 50. Outer vane element 52 is attached at base edge 52A to the outer face of rail element 51 so that base edge 52A runs diagonally across rail element 51. Inner vane element 53 is secured at base edge 53A to the inner face of rail element 51 so that base edge 53A also runs diagonally across rail element 51, but between corners of rail element 51 which are opposite to those spanned by base edge 52A of outer van element 52. The preferred method of affixing vane elements 52 and 53 to rail element 51 is the same as that described for spin vane 40, above, i.e., welding, and like vane elements 42 and 43 of spin vane 40, vane elements 52 and 53 of spin vane 50 are joined to rail element 51 so that they both are aligned perpendicularly with respect to the faces of rail element.

FIGS. 4(*b*) and 5(*b*) further show that outer vane elements 42 and 52 and inner vane elements 43 and 53 respectively will have an outer vane element height, $h_o$, and an inner vane element height, $h_i$. Vane element heights $h_o$ and $h_i$ are measured between the base edge and the outer edge of the vane elements. The ratio of outer vane element height to inner vane element height ($h_o/h_i$) may vary so as to provide for air flow volumes above and below rail elements 41 and 51, which will help to optimize burner combustion performance. As also shown in FIGS. 4(*b*) and 5(*b*), outer and inner vane elements 42 and 43 of spin vane 40 and outer and inner vane elements 52 and 53 of spin vane 50 will be oriented relative to one another so as to form an angle δ. The preferred magnitude of angle δ may range anywhere from 10 to 40 degrees, with a specific value within that range being selected so as to produce air flow patterns above and below rail elements 41 and 51, that will further help to achieve optimum burner performance.

Use of spin vane 50 may be preferred over spin vane 40 where a need exists to create air flow patterns which either converge or diverge after they leave the burner. The straight edges of outer and inner vane elements 52 and 53 can be cut at angles that will cause the air flows above and below rail element 51 to take paths that either converge or diverge by the time the flows pass the trailing edges of vane elements 52 and 53.

Figure 1:
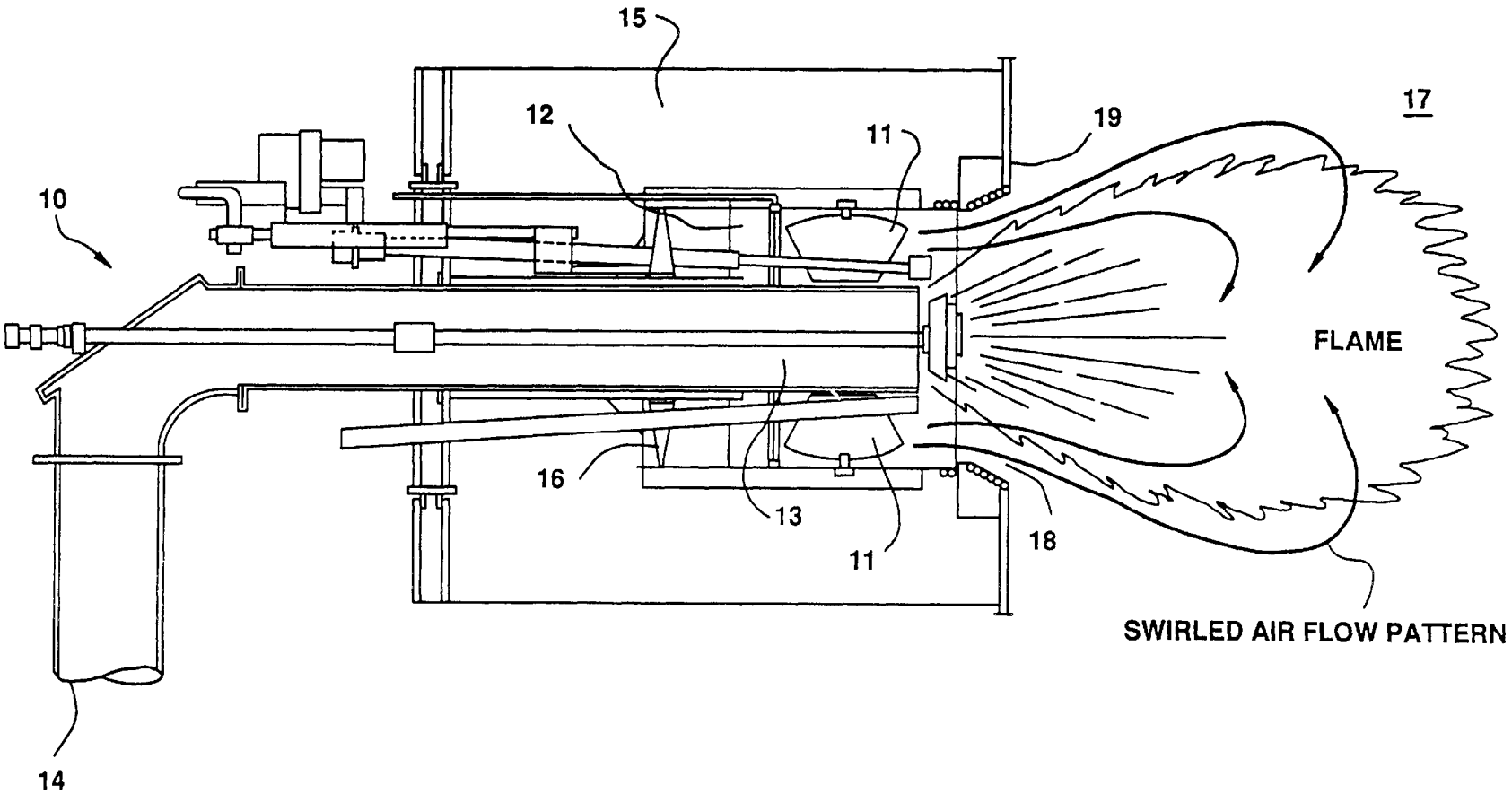
FIG. 1 PRIOR ART
FIG. 1 is a side elevational view of a known B&W single register fossil fuel-fired burner which uses spin vanes of conventional design.
Figure 2:
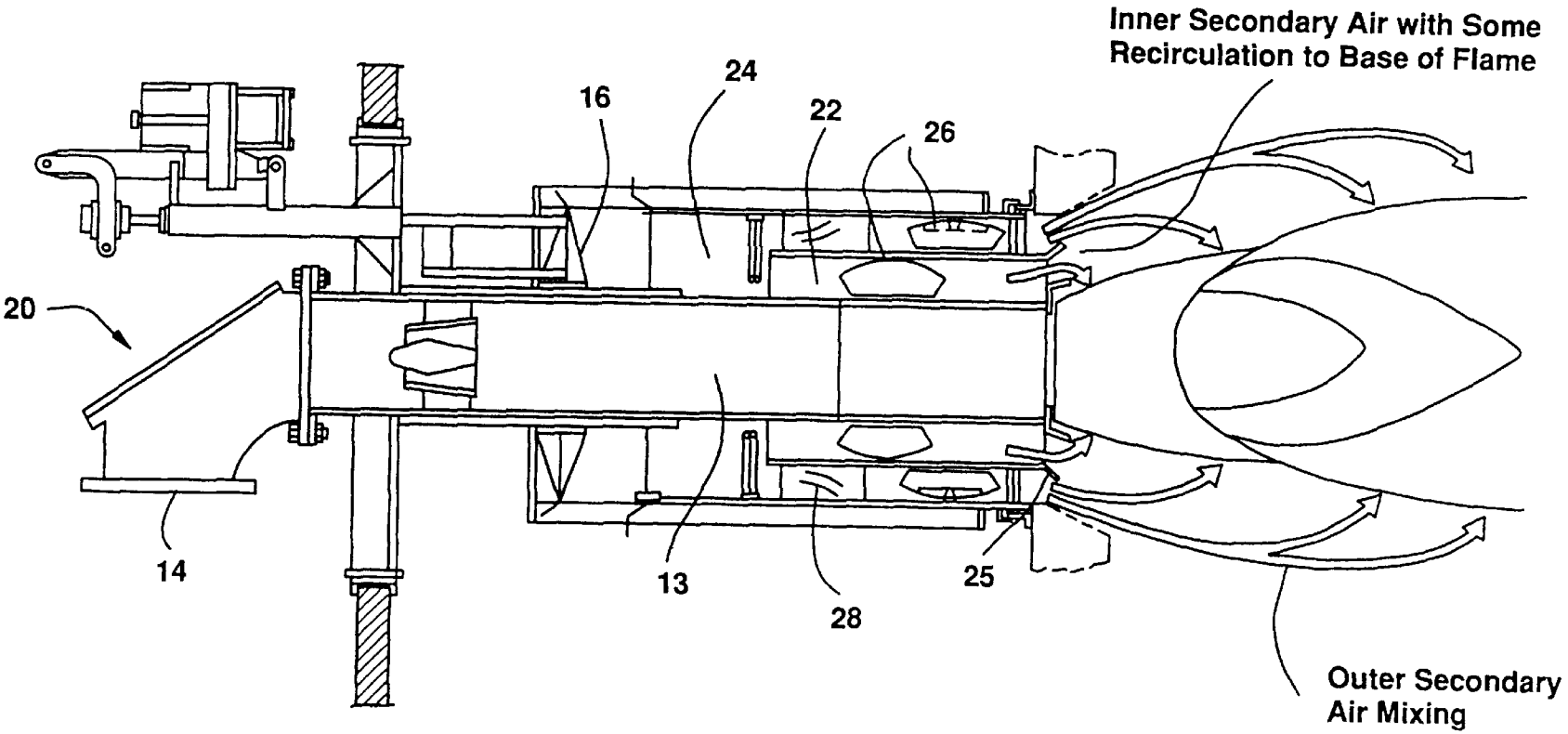
FIG.2 PRIOR ART
FIG. 2 is a side elevational view of a known B&W dual register fossil fuel-fired burner which uses spin vanes of conventional design.
Figure 3:
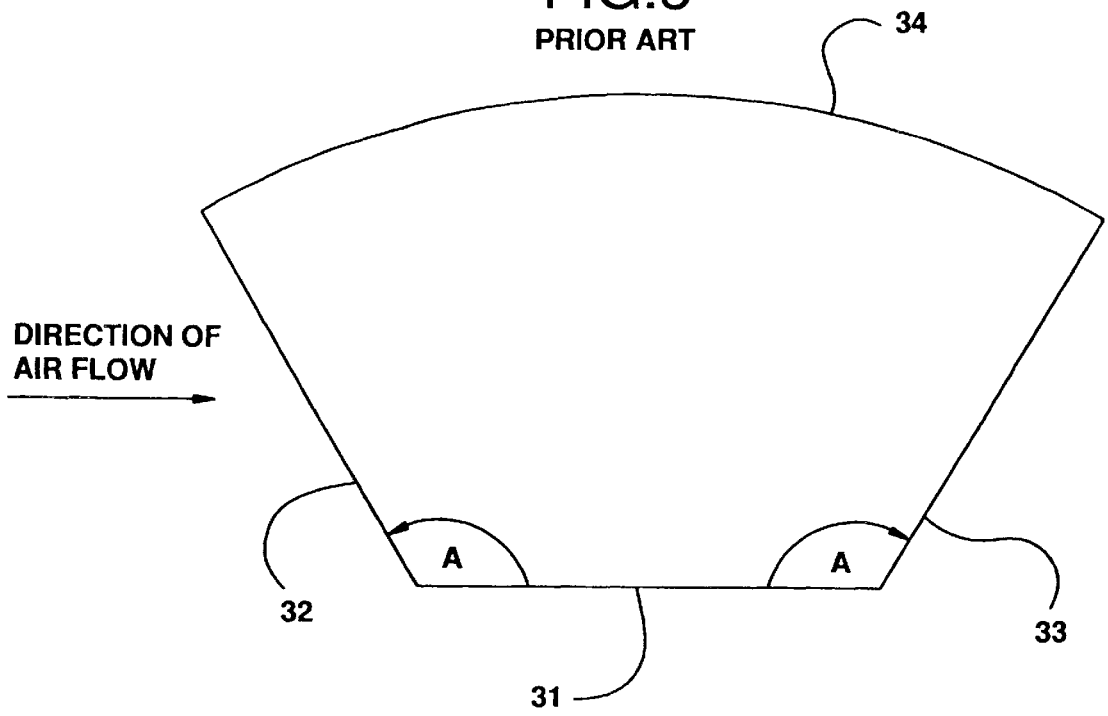
FIG.3 PRIOR ART
FIG. 3 is a side elevational view of a known spin vane.

Because each of the embodiments of the present invention create multiple air flow paths in a secondary air flow passage, the invention makes it is possible to change the aerodynamic characteristics of a known single register burner, like burner 10 shown in FIG. 1, to mimic those of a known dual register burner, like burner 20 illustrated in FIG. 2. The change may be accomplished through a simple replacement of the known single-piece spin vanes 11 with the invention. Such replacement is believed to be a low cost, time-efficient alternative to completely removing an already installed single register burner and replacing it with a higher cost dual register burner.

The present invention may also be employed to replace known spin vanes 26 of dual register burner 20 and to thereby modify the burner's aerodynamic attributes. Such a replacement may prove desirable in a situation where it is necessary for the burner to achieve emission standards which are more stringent than those currently imposed upon dual register burner users.

Figure 6:
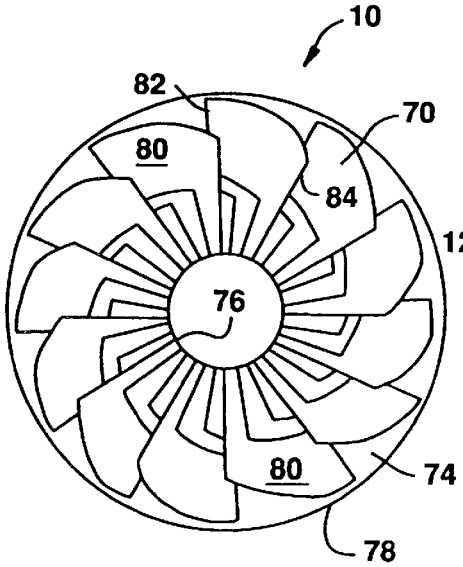
FIG. 6 is an end view of a single register burner, taken from the furnace side, employing another embodiment of the compound spin vane of the present invention.
Figure 7:
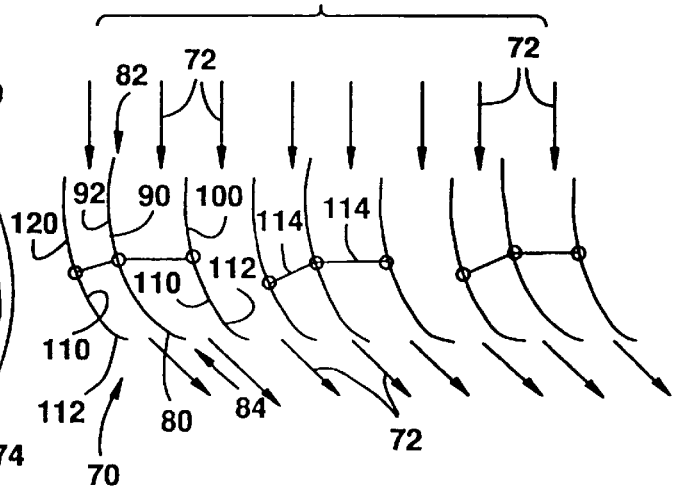
FIG. 7 is a schematic representation of the compound spin vane of FIG. 6 when viewed from the outer circumference of the annular passageway, the outer wall being removed for clarity.
Figure 13:
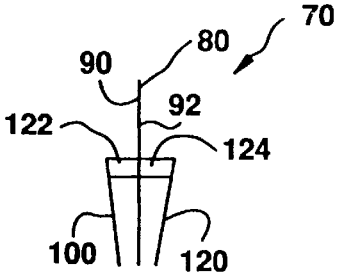
FIGS. 12–13 are a schematic representations of side and end views, respectively, of the compound spin vane of FIGS. 10 and 11.
Figure 12:
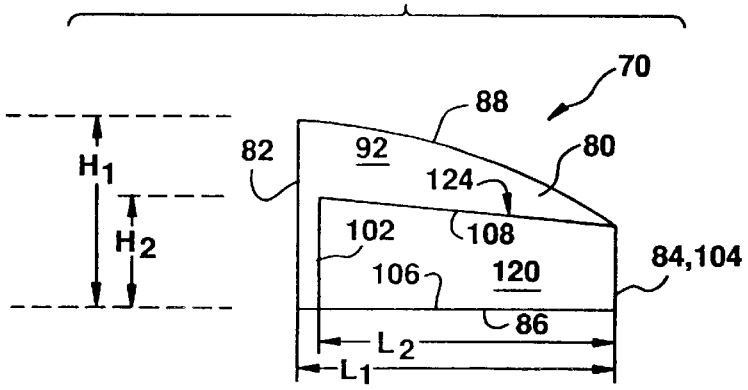
Figure 10:
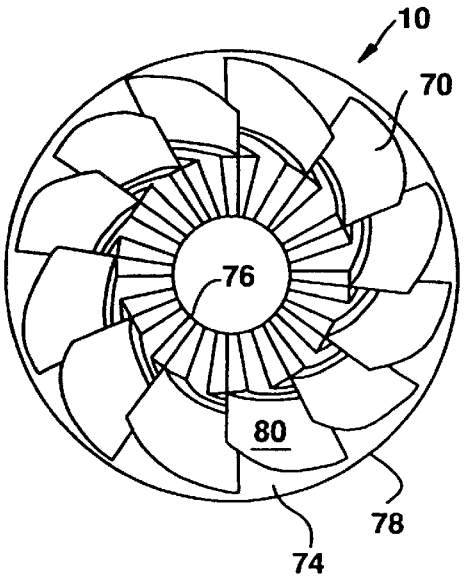
FIG. 10 is an end view of a single register burner, taken from the furnace side, employing another embodiment of the compound spin vane of the present invention.
Figure 11:
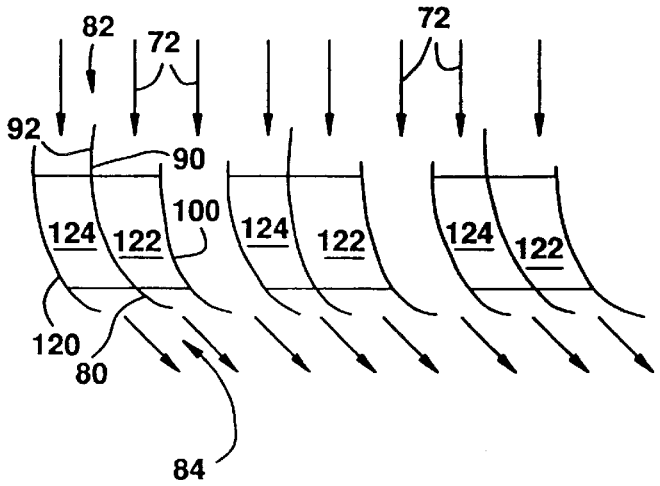
FIG. 11 is a schematic representation of the compound spin vane of FIG. 10 when viewed from the outer circumference of the annular passageway, the outer wall being removed for clarity.
Figure 17:
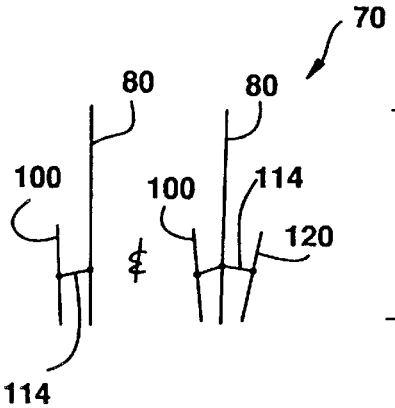
FIGS. 16–17 are schematic representations of side and end views, respectively, of the compound spin vane of FIGS. 14 and 15.
Figure 16:
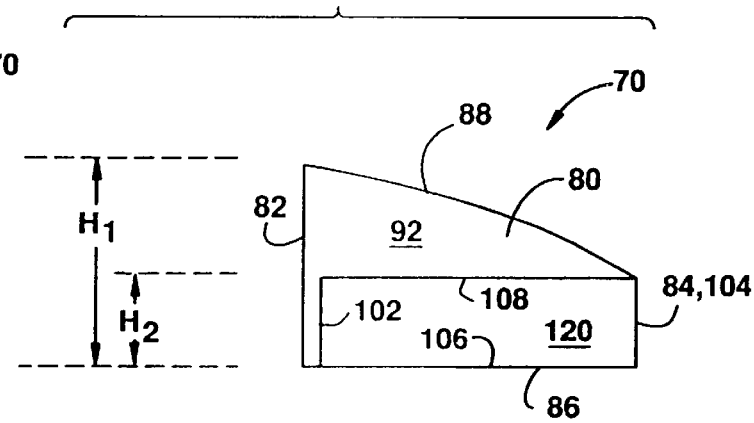

Referring to FIGS. 6–9, there is shown another embodiment of the present invention. It will be noted at the outset that in all of FIGS. 6–27, the preferred vane configuration is curved, but straight vanes could be applied in certain instances. FIG. 6 is an end view of a fossil-fueled burner apparatus, such as a single register burner 10, taken from the furnace side, employing a plurality of compound spin vanes 70 for imparting a spin to combustion air 72 flowing through an annular air flow passage 74. The passage 74 is partially defined between an inner wall 76 and an outer wall 78.

Compound spin vane 70 advantageously comprises a first vane portion 80 having a leading edge 82 exposed to the oncoming flow of air 72, a trailing edge 84 located downstream thereof with respect to the flow of air 72 as it passes by the first vane portion 80, and a length $L_1$ defined therebetween. The first vane portion 80 also has an inner edge 86, an outer edge 88, preferably curved to match the inside curvature of outer wall 78 but to allow clearance when the compound spin vane is moved, located proximate to the outer wall 78 of the annular air passage 74, and a height $H_1$ defined therebetween. The first vane portion 80 also has opposite, lateral sides 90 and 92.

A second vane portion 100 is also provided, having a leading edge 102 exposed to the oncoming flow of air 72, a trailing edge 104 downstream thereof with respect to the flow of air 72 as it passes by the second vane portion 100, and a length $L_2$ defined therebetween. Again, the second vane portion 100 also has an inner edge 106 located proximate to the inner wall 76 of the annular air passage 74, an outer edge 108, and a height $H_2$ defined therebetween. Just as was the case with the first vane portion 80, the second vane portion 100 also has opposite, lateral sides 110, 112.

Means 114, advantageously rigid links, are provided for rigidly connecting a first lateral side 110 of the second vane portion 100 to a first lateral side 90 of the first vane portion 80 in spaced lateral relationship with respect thereto. In this way, both the first and second vane portions 80, 100 can move together as a unit when the compound spin vane 70 is installed and positioned in the annular air flow passage 74 of the burner apparatus 10.

In certain circumstances, the compound spin vane 70 may also be provided with a third vane portion 120 substantially identical in configuration to the second vane portion 100. Again, means 114 would be provided for rigidly connecting a first lateral side 110 of the third vane portion 120 to a second, opposite lateral side 92 of the first vane portion 80 in spaced lateral relationship with respect to the first vane portion so that the first, second, and third vane portions 80, 100, 120 move together as a unit when the compound spin vane 70 is installed and positioned in the annular air flow passage 74 of the fossil-fueled burner apparatus 10.

FIGS. 10–13 are substantially identical to FIGS. 6–9, the main difference being that the means for rigidly connecting the second 100 and third 120 vane portions in spaced lateral relationship with respect to the first vane portion 80 comprises first rigid plate means 122 connected inbetween the one lateral side 90 of the first vane portion 80 and the first lateral side of the second vane portion, and second rigid plate means 124 connected inbetween the opposite lateral side 92 of the first vane portion 80 and the first lateral side 110 of the third vane portion 120.

Each of the first, second and third vane portions 80, 100, 120 is preferably formed as a simple, curved planar surface, and the same simple, curved planar surface would be applied to all vanes. Advantageously, the simple, curved planar surface configuration has a vane profile defined as a portion of a wall of a cylinder.

In addition to the novel compound spin vane configurations disclosed herein, an important aspect of the present invention is drawn to a fossil-fueled burner apparatus employing these constructions. In the single annular air flow passage partially defined between an inner wall and an outer wall of the burner apparatus, an arrangement of compound spin vanes is installed and positioned within the annular air flow passage for imparting a spin to combustion air flowing through the annular air flow passage. Some of the compound spin vanes comprise just the aforementioned first and second vane portions 80, 100. Of course, the fossil-fueled burner apparatus would be provided with means for field adjusting the position of the compound spin vanes to vary the amount of spin imparted to the combustion air flow flowing through the annular air flow passage and past the arrangement of compound spin vanes. In addition, some of the compound spin vanes are further comprised of the third vane portion 120 which, as mentioned earlier, is substantially identical in configuration to the second vane portion 100. Rigid connecting means, such as the links or plates, would be used as required to locate the vane portions in spaced lateral relationship with respect to each other so that the first, second, and third vane portions move together as a unit when the compound spin vane is installed and positioned in the annular air flow passage of the burner apparatus. Again, each of the first, second and third vane portions is formed as a simple, curved planar surface configuration (advantageously a section of a cylindrical surface) and each vane portion has substantially the same simple, curved planar surface configuration.

As shown in the drawings, another way to characterize the various compound spin vane configurations is to identify a ratio of the numbers of different types of vane portions provided in the burner annular air passage 74. In general, a plurality of first, second, and third vane, portions are positioned and installed in the burner apparatus. As shown in FIGS. 7, 11, 22 and 25, a ratio of (the total number of second and third vane portions) to (the total number of first vane portions) is preferably equal to 2. Alternatively, other spin vane arrangements are possible, such as those shown in FIGS. 15 and 19, wherein a plurality of first, second, and third vane portions are positioned and installed in the burner apparatus, and a ratio of (the total number of second and third vane portions) to (the total number of first vane portions) is equal to 4:3. Of course, it is possible for all of the compound spin vanes to be comprised of first, second and third vane portions.

Figure 14:
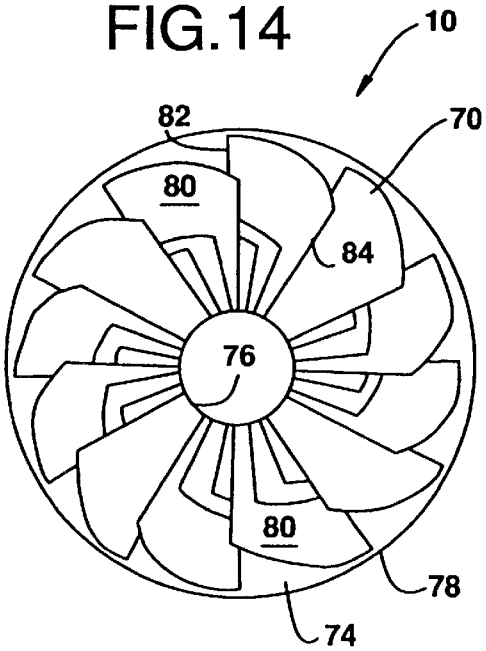
FIG. 14 is an end view of a single register burner, taken from the furnace side, employing another embodiment of the compound spin vane of the present invention.
Figure 15:
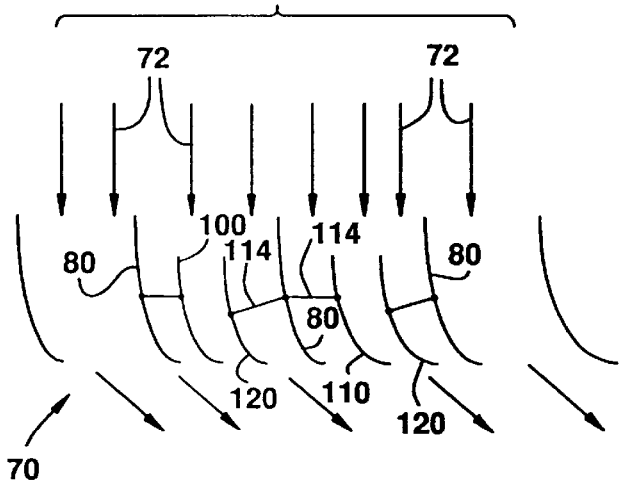
FIG. 15 is a schematic representation of the compound spin vane of FIG. 14 when viewed from the outer circumference of the annular passageway, the outer wall being removed for clarity.
Figure 21:
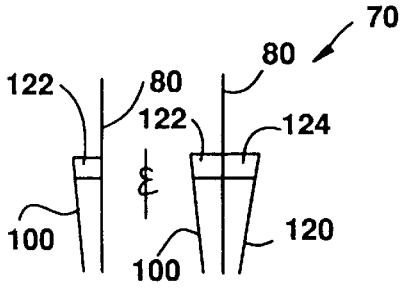
FIGS. 20–21 are schematic representations of side and end views, respectively, of the compound spin vane of FIGS. 18 and 19.
Figure 20:
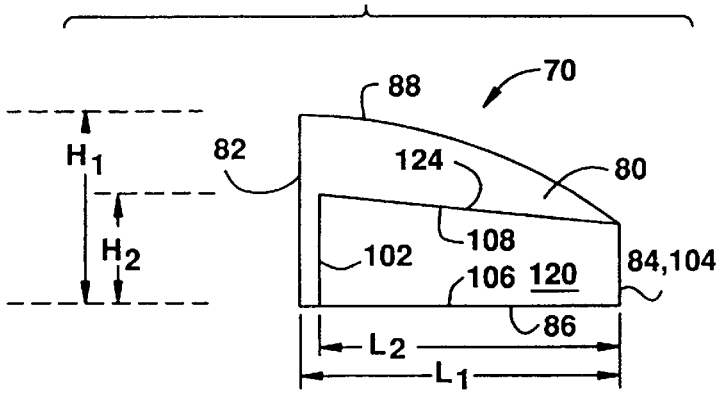
Figure 18:
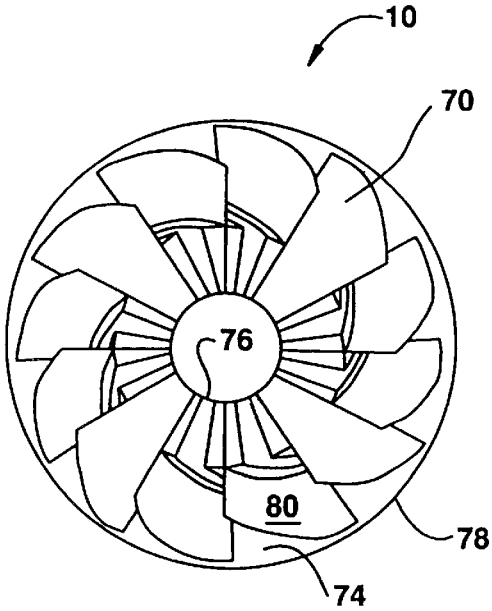
FIG. 18 is an end view of a single register burner, taken from the furnace side, employing another embodiment of the compound spin vane of the present invention.
Figure 19:
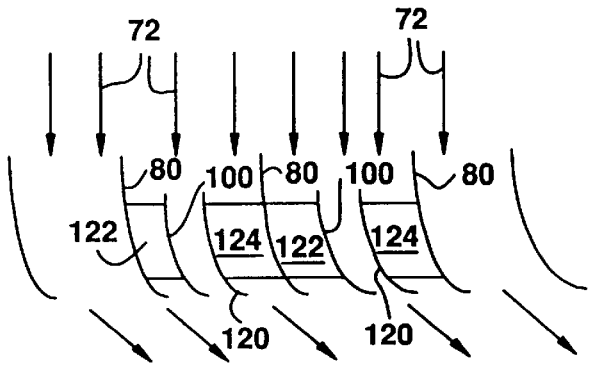
FIG. 19 is a schematic representation of the compound spin vane of FIG. 18 when viewed from the outer circumference of the annular passageway, the outer wall being removed for clarity.

Yet another way to characterize the various compound spin vane configurations is to identify a repeating pattern of compound vane types, such as shown in FIGS. 14 and 18. There, the arrangement of compound spin vanes 70 comprises, in order, a repeating pattern of: compound spin vanes having first and second vane portions, compound spin vanes having first, second and third vane portions, and compound spin vanes having first and third vane portions, installed and positioned around an entire circumference of the annular air flow passage 74.

Figure 24:
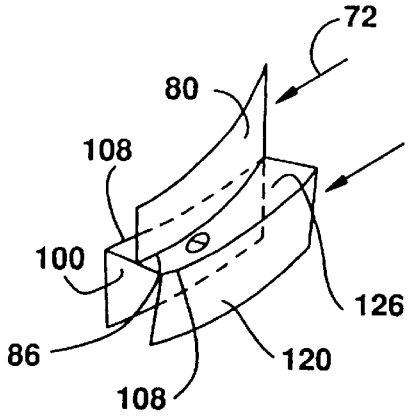
FIGS. 23–24 are schematic perspective views of the compound spin vane of FIG. 22.
Figure 23:
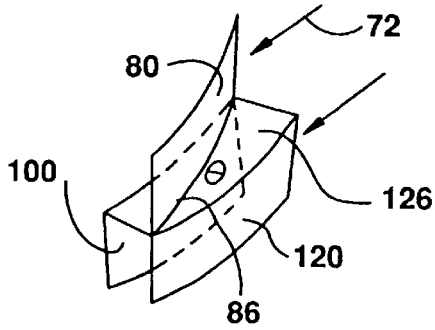
Figure 22:
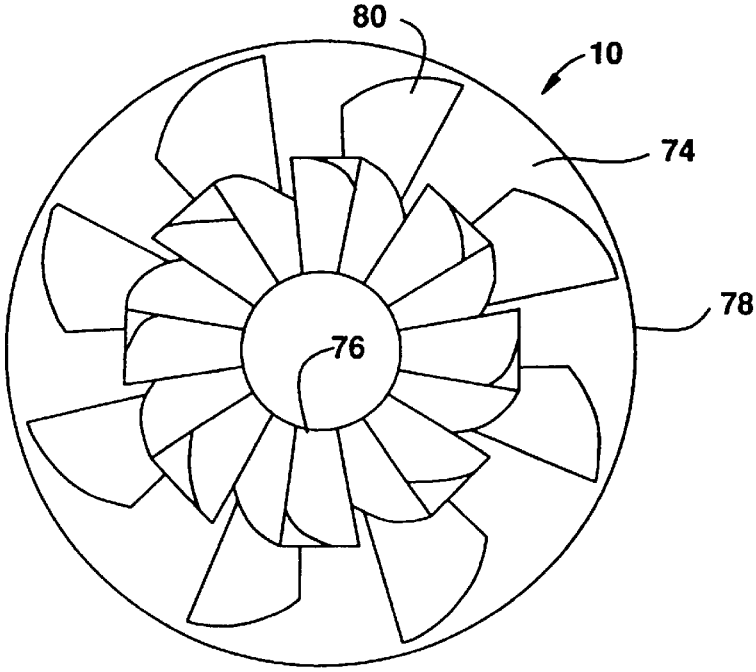
FIG. 22 is an end view of a single register burner, taken from the furnace side, employing another embodiment of the compound spin vane of the present invention.
Figure 27:
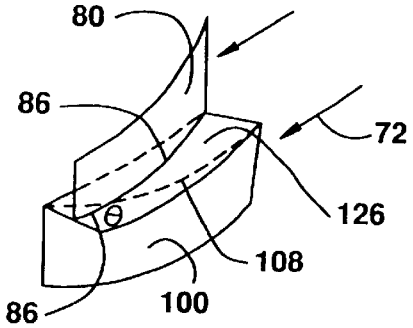
FIGS. 26–27 are schematic perspective views of the compound spin vane of FIG. 25.
Figure 26:
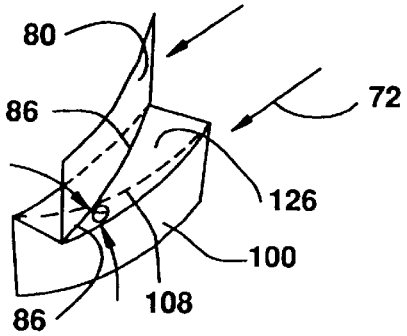
Figure 25:
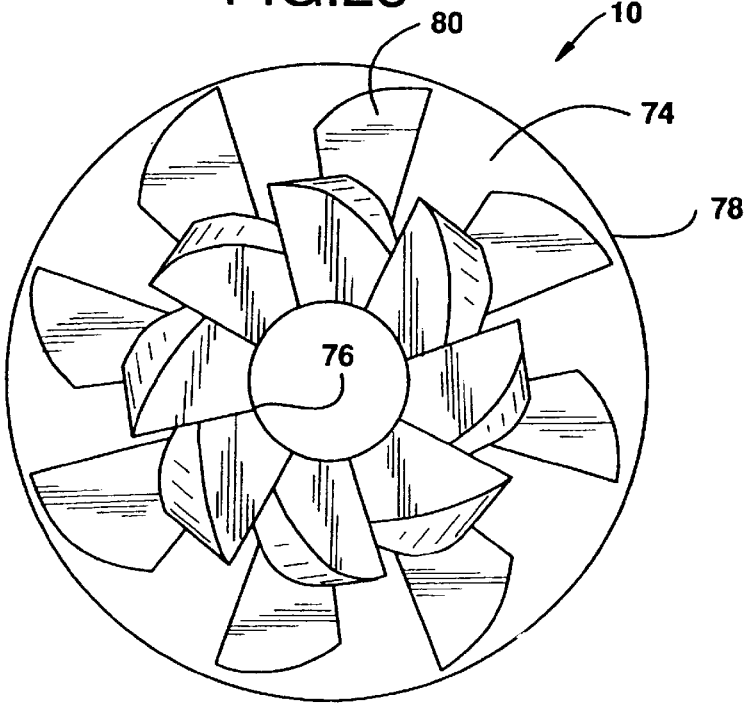
FIG. 25 is an end view of a single register burner, taken from the furnace side, employing another embodiment of the compound spin vane of the present invention.

Referring to FIGS. 22–27, there is shown another embodiment of the compound spin vanes 70 of the present invention, the fundamental difference being the particular means by which the vane portions are rigidly connected to one another. Again, these vane configurations are particularly suited to use in a fossil-fueled burner apparatus. In the case of FIGS. 22–24, the rigid plate means comprises a single plate 126 connected to the inner edge 86 of the first vane portion 80 and to the outer edges 108 of the second and third vane portions 100, 120 for rigidly connecting the second and third vane portions 100, 120 in spaced lateral relationship with respect to each other, so that the first, second, and third vane portions 80, 100, 120 move together as a unit when the compound spin vane 70 is installed and positioned in the annular air flow passage 74 of the burner apparatus 10. In FIGS. 25–27, only a single second vane portion 100 is provided. In either case, each of the first, second and third vane portions 80, 100, 120 is formed as a simple, curved planar surface configuration and each vane portion has substantially the same simple, curved planar surface configuration. However, for these embodiments, the rigid plate means 126 connects the first, second and third vane portions in a fixed relationship with respect to one another such that the trailing edge of the first vane portion is at an angle theta θ with respect to the trailing edges 84 of the second and third vane portions having a value lying within a range of 0 degrees to approximately 20 degrees.

While specific embodiments of the invention have been shown and described in detail to illustrate the application of the principles of the invention, it will be understood that the invention may be embodied otherwise without departing from such principles. For example, the present invention may be applied in new construction involving existing single register burner apparatus, or to the replacement, repair or improvement of existing burner apparatus. As discussed in connection with the various forms of the CBV having the first, second and third vane portions, in some embodiments of the invention, certain features of the invention may sometimes be used to advantage without a corresponding use of the other features. Accordingly, all such changes and embodiments properly fall within the scope of the following claims.

What is claimed is:

1. A compound spin vane assembly for imparting a spin to air flowing through an annular air flow passage having a longitudinal axis of symmetry, the passage being partially defined between an inner wall and an outer wall, comprising:

an annular flow passage having an inner wall and an outer wall;

a first vane portion having a leading edge exposed to the oncoming flow of air, a trailing edge located downstream thereof with respect to the flow of air as it passes by the first vane portion, the first vane portion also having an inner edge, an outer edge located proximate to the outer wall of the annular air passage, and opposite, lateral sides;

a second vane portion having a leading edge exposed to the oncoming flow of air, a trailing edge downstream thereof with respect to the flow of air as it passes by the second vane portion, the second vane portion also having an inner edge located proximate to the inner wall of the annular air passage, an outer edge, and opposite, lateral sides;

a third vane portion substantially identical in configuration to the second vane portion; and means for rigidly connecting at least one side of the first vane portion to both the opposite lateral side of the second vane portion and the opposite lateral side of the third vane portion, wherein the means for rigidly connecting is situated in spaced lateral relationship with respect to the first vane portion so that the first, second, and third vane portions move together as a unit with respect to the annular flow passage and wherein the means for rigidly connecting is positioned in the annular air flow passage.

2. The compound spin vane according to claim 1, wherein the means for rigidly connecting comprises first rigid link means connected inbetween the one lateral side of the first vane portion and the one lateral side of the second vane portion and second rigid link means connected inbetween the opposite lateral side of the first vane portion and the one lateral side of the third vane portion.

3. The compound spin vane according to claim 1, wherein the means for rigidly connecting comprises first rigid plate means connected inbetween the one lateral side of the first vane portion and the one side of the second vane portion, and second rigid plate means connected inbetween the opposite lateral side of the first vane portion and the one side of the third vane portion.

4. The compound spin vane according to claim 1, wherein each of the first, second and third vane portions is formed as a simple, curved planar surface configuration and each vane portion has substantially the same simple, curved planar surface configuration.

5. The compound spin vane according to claim 4, wherein the simple, curved planar surface configuration has a vane profile defined as a portion of a wall of a cylinder.

6. A compound spin vane apparatus for imparting a spin to air flowing past the spin vane apparatus comprising:

a first vane portion having: a leading edge exposed to an oncoming flow of air; a trailing edge located downstream thereof with respect to the flow of air as it passes by the first vane portion; an inner edge oriented in a substantially parallel relation to the oncoming flow of air; an outer edge located opposite the inner edge; and wherein the first vane portion is formed as a simple curved planar surface;

second and third vane portions each having: a leading edge exposed to the oncoming flow of air; a trailing edge downstream thereof with respect to the flow of air as it passes by the second vane portion; an inner edge oriented in a substantially parallel relation to the oncoming flow of air; an outer edge located opposite the inner edge; and wherein each of the second and third vane portions are formed as simple, curved planar surfaces that are substantially the same simple, curved planar surface as the first vane portion; and rigid plate means for connecting the first, second and third vane portions in spaced lateral relationship with respect to each other, the plate means being connected to the inner edge of the first vane portion and to the outer edges of the second and third vane portions so that the rigid plate means and the first, second, and third vane portions all move in unison as a single unit.

7. The compound spin vane according to claim 6, wherein the rigid plate means connects the first, second and third vane portions in a fixed relationship with respect to one another such that the trailing edge of the first vane portion is at an angle with respect to the trailing edges of the second and third vane portions lying within a range of 0 degrees to approximately 20 degrees.

8. A fossil-fueled burner apparatus comprising:

an annular air flow passage of a burner apparatus having an inner wall and an outer wall and combustion air flowing therethrough;

an arrangement of compound spin vanes, at least one of the compound spin vanes having: a first vane portion having a leading edge exposed to the oncoming flow of air, a trailing edge located downstream thereof with respect to the flow of air as it passes by the first vane portion, the first vane portion also having an inner edge, an outer edge located proximate to the outer wall of the annular air passage, and opposite, lateral sides; a second vane portion having a leading edge exposed to the oncoming flow of air, a trailing edge downstream thereof with respect to the flow of air as it passes by the second vane portion, the second vane portion also having an inner edge located proximate to the inner wall of the annular air passage, an outer edge, and opposite, lateral sides; and means for rigidly connecting one side of the second vane portion to a first lateral side of the first vane portion in spaced lateral relationship with respect to the first vane portion so that both the first and second vane portions move together as a unit with respect to the annular flow passage and wherein the means for rigidly connecting is positioned in the annular air flow passage; and means for adjusting position of the compound spin vanes to vary the amount of spin imparted to the combustion air flow flowing through the annular air flow passage and past the arrangement of compound spin vanes.

9. The fossil-fueled burner apparatus according to claim 8, wherein at least one of the compound spin vanes further comprises:

a third vane portion substantially identical in configuration to the second vane portion; and means for rigidly connecting one side of the third vane portion to a second, opposite lateral side of the first vane portion in spaced lateral relationship with respect to the first vane portion so that the first, second, and third vane portions move together as a unit with respect to the annular flow passage and wherein the means for rigidly connecting is positioned in the annular air flow passage.

10. The fossil-fueled burner apparatus according to claim 9, wherein the means for rigidly connecting the second and third vane portions in spaced lateral relationship with respect to the first vane portion comprises first rigid link means connected inbetween the one lateral side of the first vane portion and the one side of the second vane portion, and second rigid link means connected inbetween the opposite lateral side of the first vane portion and the one side of the second vane portion.

11. The fossil-fueled burner apparatus according to claim 9, wherein the means for rigidly connecting the second and third vane portions in spaced lateral relationship with respect to the first vane portion comprises first rigid plate means connected inbetween the one lateral side of the first vane portion and the one side of the second vane portion, and second rigid plate means connected inbetween the opposite lateral side of the first vane portion and the one side of the second vane portion.

12. The fossil-fueled burner apparatus according to claim 9, wherein each of the first, second and third vane portions is formed as a simple, curved planar surface configuration and each vane portion has substantially the same simple, curved planar surface configuration.

13. The fossil-fueled burner apparatus according to claim 12, wherein the simple, curved planar surface configuration has a vane profile defined as a portion of a wall of a cylinder.

14. The fossil-fueled burner apparatus according to claim 9, wherein a ratio of (the total number of second and third vane portions) to (the total number of first vane portions) is equal to 2.

15. The fossil-fueled burner apparatus according to claim 9, wherein a ratio of (the total number of second and third vane portions) to (the total number of first vane portions) is equal to 4:3.

16. The fossil-fueled burner apparatus according to claim 9, wherein all of the compound spin vanes are comprised of first, second and third vane portions.

17. The fossil-fueled burner apparatus according to claim 9, wherein the arrangement of compound spin vanes comprises, in order, a repeating pattern of: compound spin vanes having first and second vane portions, compound spin vanes having first, second, and third vane portions, and compound spin vanes having first and third vane portions, installed and positioned around an entire circumference of the annular air flow passage.

* * * * *